US007648207B2

(12) United States Patent
Lai

(10) Patent No.: US 7,648,207 B2
(45) Date of Patent: Jan. 19, 2010

(54) ROTATING STRUCTURE FOR ARMRESTS

(76) Inventor: Yu-Shan Lai, No.632, Sec. 1, Shihsian Rd., West District, Chiayi City 600 (TW)

( * ) Notice: Subject to any disclaimer, the term of this patent is extended or adjusted under 35 U.S.C. 154(b) by 0 days.

(21) Appl. No.: 12/023,167

(22) Filed: Jan. 31, 2008

(65) Prior Publication Data

US 2009/0195045 A1 Aug. 6, 2009

(51) Int. Cl.
*A47C 7/54* (2006.01)

(52) U.S. Cl. ..... 297/411.31

(58) Field of Classification Search ..... 297/411.31, 297/411.37, 411.38, 344.22
See application file for complete search history.

(56) References Cited

U.S. PATENT DOCUMENTS 4,496,190 A * 1/1985 Barley ..... 297/411.38
5,590,934 A * 1/1997 Gibbs ..... 297/411.38
5,599,067 A * 2/1997 Schuelke et al. ..... 297/411.35
5,884,976 A * 3/1999 Breen et al. ..... 297/411.37
6,053,578 A * 4/2000 van Hekken et al. ... 297/411.35
7,559,609 B2 * 7/2009 Tsai ..... 297/411.35

* cited by examiner

*Primary Examiner*—Joseph F Edell
(74) *Attorney, Agent, or Firm*—Alan Kamrath; Kamrath & Associates PA

(57) ABSTRACT

A rotating structure for armrests includes a rotary plate disposed onto a support mounted to a holder extending upwardly on each of two sides of a chair. The support includes a receiving chamber formed on the top surface thereof and having a plurality of toothed recesses arranged around the external rim thereof. The rotary plate includes a pivotal member extending therefrom corresponding to the support and having a cutout fixed on one side thereof for receiving a slidable retaining tab which is biased by a spring. The retaining tab includes a number of toothed protrusions attached thereon and engaging with the toothed recesses. The bottom of a holding panel for placing a user's elbow may be assembled with the rotary plate, thereby obtaining a quick and secure positioning purpose and preventing making noise while in operation.

4 Claims, 6 Drawing Sheets

ROTATING STRUCTURE FOR ARMRESTS

BACKGROUND OF THE INVENTION

1. Field of the Invention

The present invention relates to a rotating structure and, more particularly, to a rotating structure for armrests that may obtain a quick and secure positioning purpose and may prevent making noise while in operation.

2. Description of the Prior Arts

Conventional armrests may be adjusted to move upwardly and downwardly. However, rotary angular adjustment of armrests may not be achieved before.

To improve the above-mentioned defect, an improved angular adjusting structure has been developed. Specifically, a holding panel is pivotally connected with a support, and a biasing member (such as a biasing ball) is defined between the holding panel and the support so as to generate an engaging force by the biasing member. However, such an angular adjusting structure always makes considerable noise while in use.

The present invention has arisen to mitigate and/or obviate the afore-described disadvantages.

SUMMARY OF THE INVENTION

The primary object of the present invention is to provide a rotating structure for armrests that may obtain a quick and secure positioning purpose.

Another object of the present invention is to provide a rotating structure for armrests that may prevent making noise while in operation.

In accordance with one aspect of the present invention, there is provided a rotating structure for armrests comprising a rotary plate disposed onto the top surface of a support for assembling with a holding panel;

the support is mounted to a holder extending upwardly on each of two sides of a chair and includes a receiving chamber formed on the top surface thereof and having a plurality of toothed recesses arranged around the external rim thereof;

the rotary plate includes a pivotal member extending therefrom and corresponding to the receiving chamber and having a cutout fixed on one side thereof for receiving a slidable retaining tab which is biased by a spring, the retaining tab includes a number of toothed protrusions attached thereon and engaging with the toothed recesses; and the bottom of the holding panel for placing a user's elbow may be assembled with the rotary plate.

The present invention will become more obvious from the following description when taken in connection with the accompanying drawings, which show, for purpose of illustration only, the preferred embodiment in accordance with the present invention.

DETAILED DESCRIPTION OF THE PREFERRED EMBODIMENT

Figure 1:
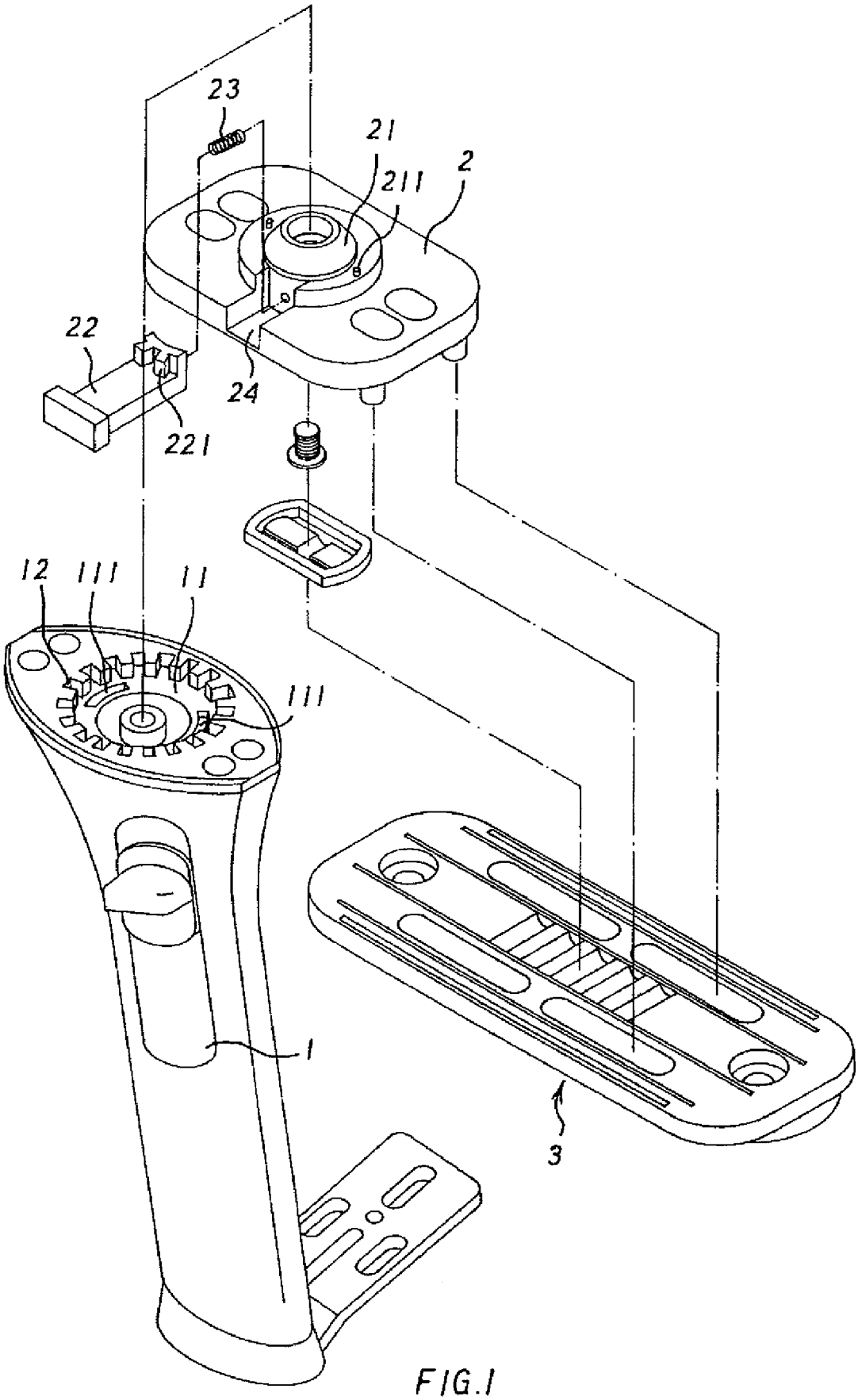
FIG. 1 is a perspective view illustrating the exploded components of a rotating structure for armrests according to the present invention.
Figure 2:
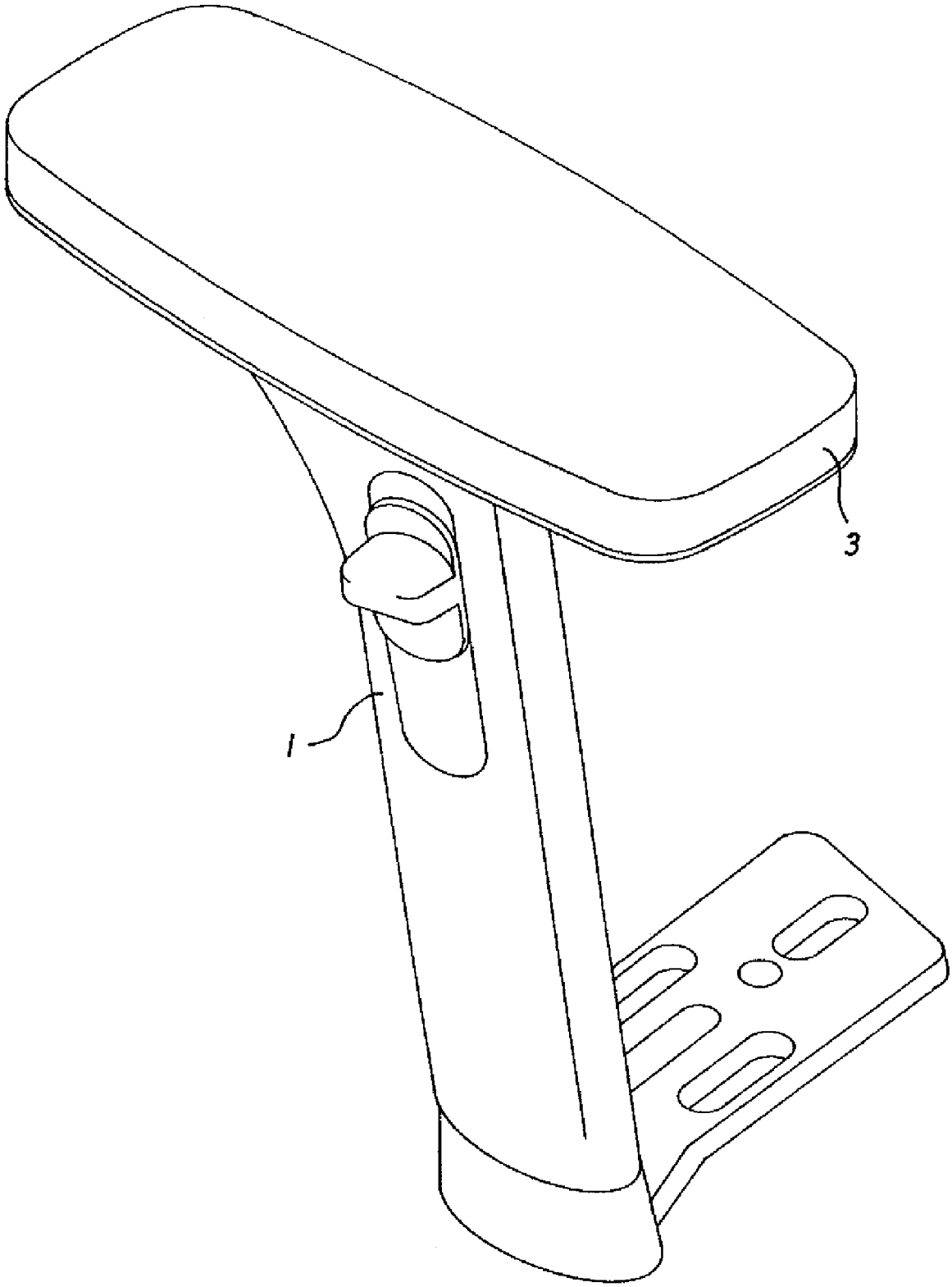
FIG. 2 is a perspective view illustrating the assembly of the rotating structure for armrests according to the present invention.

Referring to FIGS. 1 and 2, a rotating structure for armrests in accordance with the present invention includes a rotary plate 2 disposed onto the top surface of a support 1 for assembling with a holding panel 3.

The support 1 is mounted to a holder extending upwardly on each of two sides of a chair. The support 1 includes a receiving chamber 11 formed on the top surface thereof and having a plurality of toothed recesses 12 arranged around the external rim thereof. It is to be noted that the support 1 may be provided with a vertically moveable adjusting structure.

The rotary plate 2 includes a pivotal member 21 extending therefrom, corresponding to the receiving chamber 11 of the support 1 and having a cutout 24 fixed on one side thereof for receiving a slidable retaining tab 22 which is biased by a spring 23. The retaining tab 22 includes a number of toothed protrusions 221 attached thereon and engaging with the toothed recesses 12.

The holding panel 3 is used for placing a user's elbow, and its bottom may be assembled with the rotary plate 2. It is to be noted that the holding panel 3 may be provided with a frontward and rearward moving structure.

In assembly, the retaining tab 22 is biased by the spring 23 in the cutout 24 for matching with the outer diameter of the pivotal member 21. Thus, the pivotal member 21 may be correspondingly received into the receiving chamber 11 of the support 1. Also, the rotary plate 2 is axially affixed onto the support 1 and then assembled with the holding panel 3, thus finishing the assembly.

Figure 3:
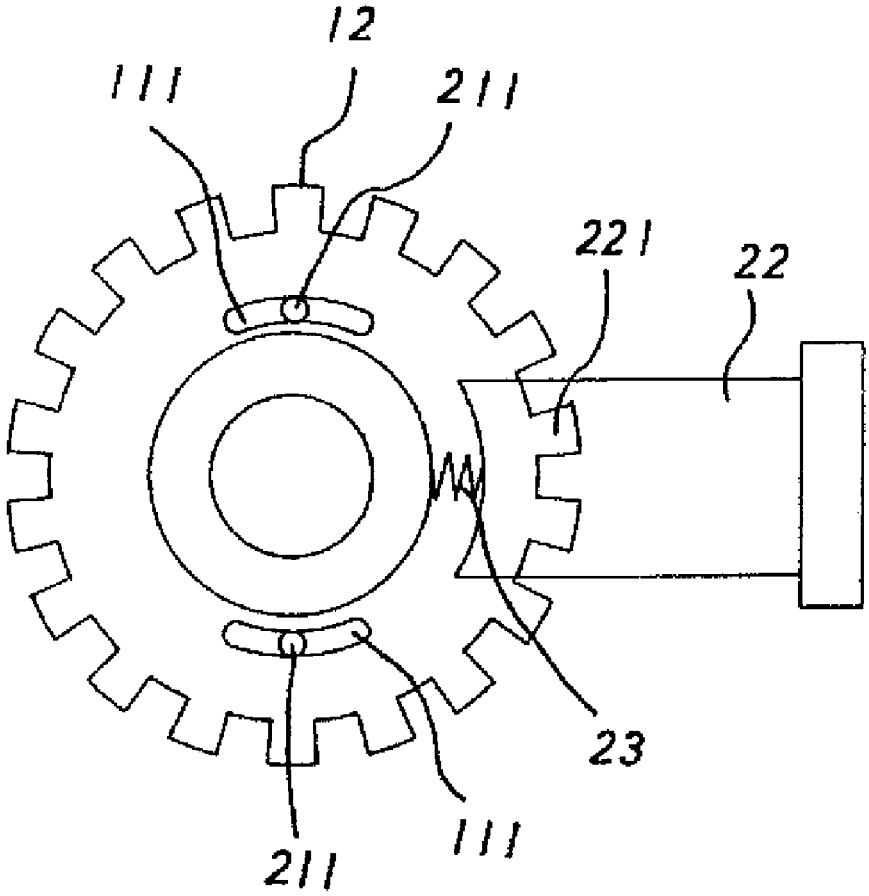
FIG. 3 is a plan view illustrating the operation of a slidable retaining tab and a plurality of toothed recesses according to the present invention.
Figure 4:
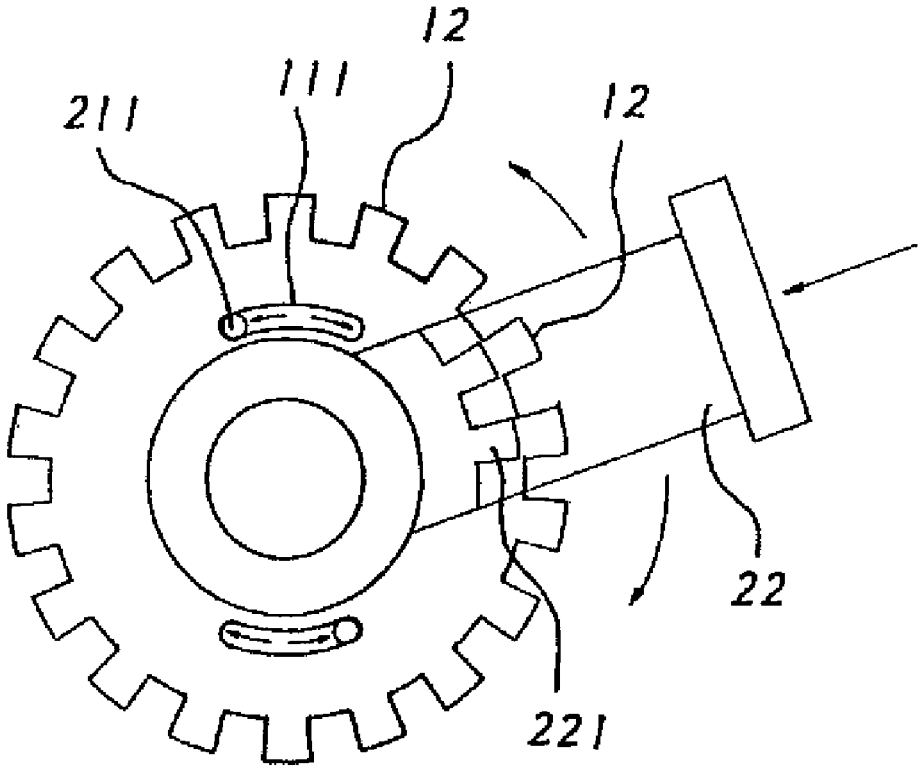
FIG. 4 is another plan view illustrating the operation of a slidable retaining tab and the toothed recesses according to the present invention.

In operation, the retaining tab 22 is biased against the toothed recesses 12 by the spring 23 (as illustrated in FIG. 3). Thus, the rotary plate 2 and the support 1 may be positioned to locate the holding panel 3 relative to the support 1. Further, after the user presses the retaining tab 22, the spring 23 is urged to move inward so that the retaining tab 22 disengages from the toothed recesses 12 (as shown in FIG. 4). Hence, the rotary plate 2 may be adjustably rotated relative to the support 1, and the angular position of the holding panel 3 may be quickly adjusted on the basis of the user's requirement. Thereafter, the retaining tab 22 is released and is pushed toward the toothed recesses 12 by the spring 23, such that the toothed protrusions 221 may relatively engage with the toothed recesses 12, obtaining a quick and secure positioning purpose.

Figure 5:
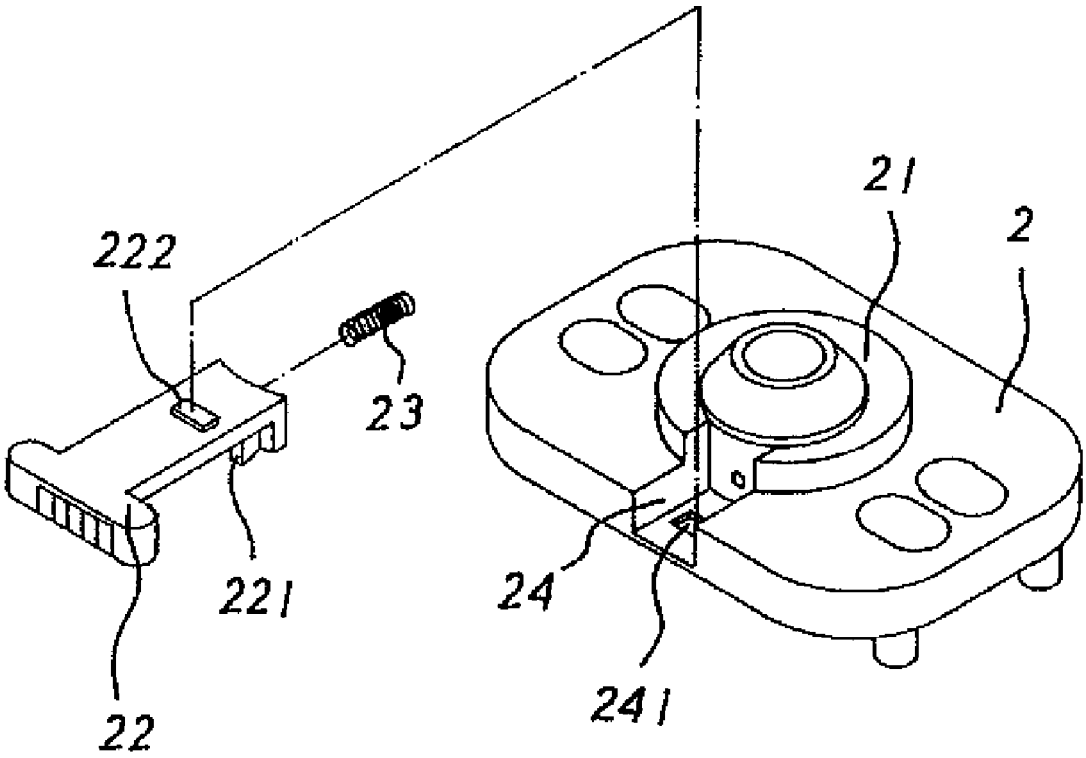
FIG. 5 is a perspective view illustrating the exploded components of a rotary plate according to the present invention.
Figure 6:
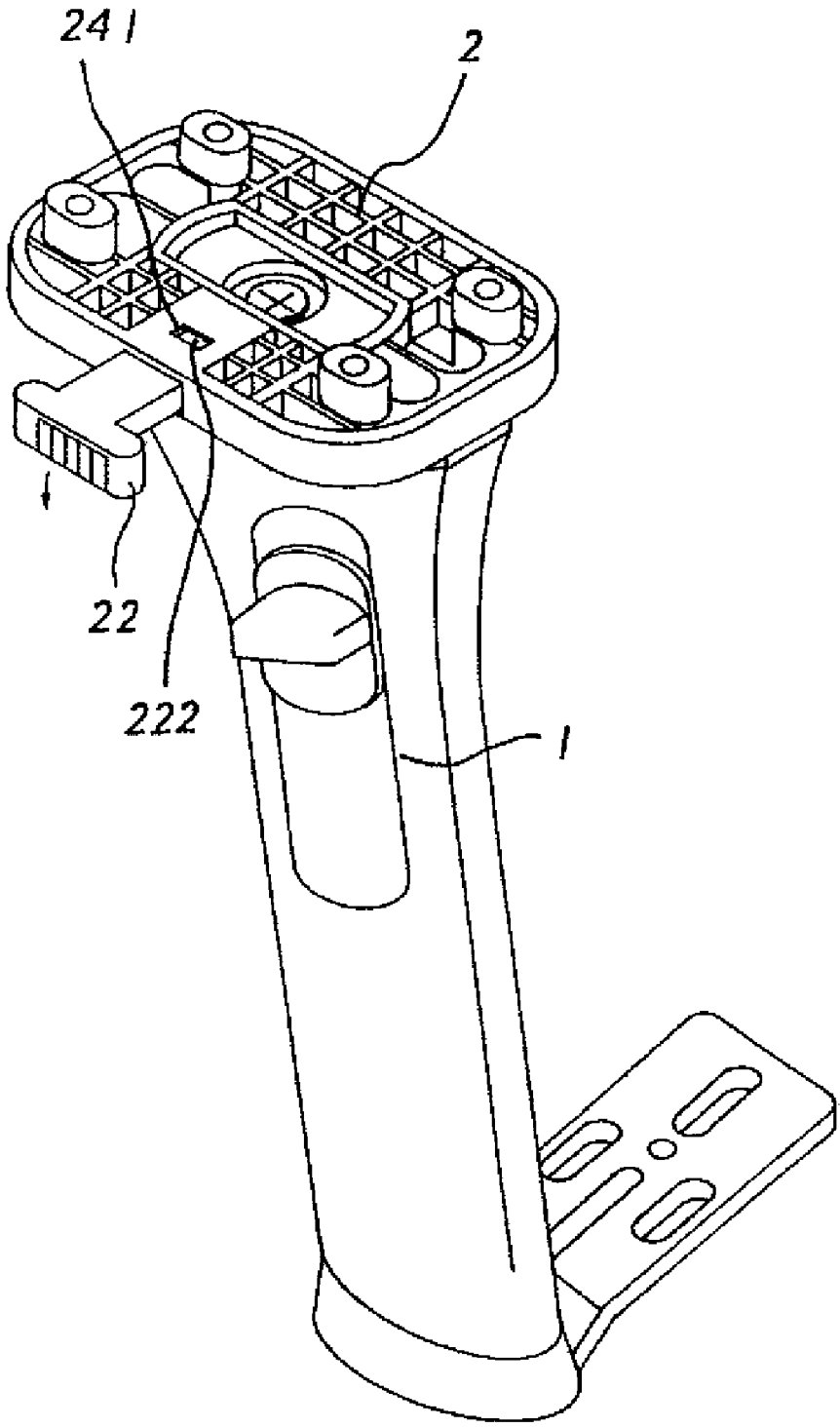
FIG. 6 is another perspective view illustrating the assembly of the rotating structure for armrests according to the present invention.

Furthermore, the retaining tab 22 may be received into the cutout 24 with a gap by which a projection 222 and an indentation 241 corresponding to each other (as illustrated in FIGS. 5-6) are provided between the retaining tab 22 and the cutout 24. Therefore, during adjusting the angle of the holding panel 3, the retaining tab 22 may be pressed into the cutout 24, and the projection 222 on the retaining tab 22 is received into the indentation 241 so that the spring 23 is pressed and the toothed protrusions 221 are disengaged from the toothed recesses 12. Thus the user may freely rotate the holding panel 3 for adjusting to a desired angle. Thereafter, the retaining tab 22 is moved to disengage the projection 222 from the indentation 241, thus returning to the engaging status by the spring 23 to achieve a quick operation.

On the other hand, on the corresponding surface where the rotary plate 2 is axially connected with the support 1 are provided with a plurality of pegs 211 and arcuate slots 111. Thus, the rotary plate 2 may be moved relative to the support 1 to have an angular adjustment limited within the movable length of the pegs 211 in the arcuate slots 111, thereby achieving an angular rotation limitation of the holding panel 3 relative to the support 1.

The invention is not limited to the above embodiment but various modifications thereof may be made. It will be understood by those skilled in the art that various changes in form and detail may be made without departing from the scope and spirit of the present invention.

What is claimed is:

1. A rotating structure for armrests comprising:

a support mounted to a holder and including a top surface;

a receiving chamber formed in the top surface of the support and having an external rim;

a plurality of toothed recesses arranged around the external rim of the receiving chamber;

a rotary plate including a pivotal member extending therefrom and having circular cross sections including an outer diameter, with the pivotal member corresponding to and pivotally received in the receiving chamber of said support, with the pivotal member having a cutout fixed on one side thereof and extending radially relative to the circular cross sections of the pivotal member;

a slidable retaining tab slideable in the cutout and biased against the receiving chamber by a spring, wherein said retaining tab includes toothed protrusions attached thereon and engaging with said toothed recesses;

a holding panel for placing a user's elbow, and a bottom of the holding plate assembled with said rotary plate;

wherein said retaining tab is biased by said spring in said cutout for matching with the outer diameter of said pivotal member so that said pivotal member is correspondingly received into said receiving chamber of said support, and wherein said rotary plate is axially affixed onto said support and assembled with said holding panel.

2. The rotating structure for armrests as claimed in claim 1, further comprising: a projection formed on one of said retaining tab and said cutout; and an indentation formed in another of the retaining tab and the cutout, with the projection and the indentation corresponding to each other, wherein when said retaining tab is pressed into said cutout, said projection is received into said indentation so that said spring is pressed and said toothed projections are disengaged from said toothed recesses, and wherein when said retaining tab is moved to disengage said projection from said indentation, said spring biases the slideable retaining tab to engage the toothed protrusions with said toothed recesses to achieve an easy and quick operation.

3. The rotating structure for armrests as claimed in claim 2, further comprising: a plurality of pegs on one of the receiving chamber and the pivotal member; and arcuate slots formed in another of the receiving chamber and the pivotal member and corresponding to and receiving the plurality of pegs, with the arcuate slots being concentric within the external rim and to the outer diameter of said pivotal member, thereby achieving an angular limitation of said holding plate relative to said support.

4. The rotating structure for armrests as claimed in claim 1, further comprising: a plurality of pegs on one of the receiving chamber and the pivotal member; and arcuate slots formed in another of the receiving chamber and the pivotal member and corresponding to and receiving the plurality of pegs, with the arcuate slots being concentric within the external rim and to the outer diameter of said pivotal member, thereby achieving an angular limitation of said holding plate relative to said support.

* * * * *